US011414789B2

(12) United States Patent
Lindström et al.

(10) Patent No.: US 11,414,789 B2
(45) Date of Patent: Aug. 16, 2022

(54) CELLULOSE FIBERS

(71) Applicant: RE:NEWCELL AB, Stockholm (SE)

(72) Inventors: Mikael Lindström, Lidingö (SE); Christofer Lindgren, Stockholm (SE); Gunnar Henriksson, Solna (SE)

(73) Assignee: RE:NEWCELL AB, Stockholm (SE)

( * ) Notice: Subject to any disclaimer, the term of this patent is extended or adjusted under 35 U.S.C. 154(b) by 21 days.

(21) Appl. No.: 16/466,030

(22) PCT Filed: Dec. 5, 2017

(86) PCT No.: PCT/EP2017/081569
§ 371 (c)(1),
(2) Date: Jun. 2, 2019

(87) PCT Pub. No.: WO2018/104330
PCT Pub. Date: Jun. 14, 2018

(65) Prior Publication Data

US 2020/0063293 A1 Feb. 27, 2020

(30) Foreign Application Priority Data

Dec. 6, 2016 (SE) ..... 1651600-7

(51) Int. Cl.

| | |
|---|---|
| ***D01F 2/02*** | (2006.01) |
| ***D01F 2/06*** | (2006.01) |
| ***D21C 9/153*** | (2006.01) |
| ***D21C 9/147*** | (2006.01) |

(52) U.S. Cl.
CPC ..... *D01F 2/02* (2013.01); *D01F 2/06* (2013.01); *D21C 9/147* (2013.01); *D21C 9/153* (2013.01)

(58) Field of Classification Search
None
See application file for complete search history.

(56) References Cited

U.S. PATENT DOCUMENTS

| | | | | |
|---|---|---|---|---|
| 3,694,309 | A * | 9/1972 | Gierer | D21C 9/163 162/65 |
| 4,246,221 | A | 1/1981 | McCorsley, III | |
| 5,601,767 | A * | 2/1997 | Firgo | D01F 2/00 264/101 |
| 5,609,676 | A | 3/1997 | von der Eltz | |
| 2012/0000621 | A1* | 1/2012 | Stigsson | C08B 16/00 162/158 |
| 2016/0060814 | A1* | 3/2016 | Hauschel | D21H 21/30 162/135 |
| 2016/0369456 | A1* | 12/2016 | Flynn | D21H 17/005 |
| 2017/0350072 | A1* | 12/2017 | Lund | D21C 5/005 |
| 2018/0002836 | A1* | 1/2018 | Sperger | C08B 16/00 |

FOREIGN PATENT DOCUMENTS

| | | | |
|---|---|---|---|
| CN | 102747622 | A | 10/2012 |
| WO | 2004085735 | A1 | 10/2004 |
| WO | 20101124944 | A1 | 11/2010 |
| WO | 2012057684 | A1 | 5/2012 |
| WO | 2013004909 | A1 | 1/2013 |
| WO | 2013124265 | A1 | 8/2013 |
| WO | 2014045062 | A1 | 3/2014 |
| WO | 2014162062 | A1 | 10/2014 |
| WO | 2015077807 | A1 | 6/2015 |
| WO | 2016080895 | A1 | 5/2016 |

OTHER PUBLICATIONS

Björquist, Stina et al., "Textile qualities of regenerated cellulose fibers from cotton waste pulp," Textile Research Journal 2018, vol. 88(21) 2485-2492.
International Search Report and Written Opinion for PCT/EP2017/081569 dated Jan. 24, 2018.

* cited by examiner

*Primary Examiner* — Katie L. Hammer
(74) *Attorney, Agent, or Firm* — Renner, Otto, Boisselle & Sklar, LLP

(57) ABSTRACT

There is provided a cellulose based fiber made of a i) cellulose dissolving pulp, and ii) a recycled cellulose textile, which is treated to swell the cellulose with a reducing additive and a) bleached with oxygen at alkaline conditions with a pH in the range 9-13.5 and/or b) bleached with ozone at acid conditions below pH 6, wherein the cellulose based fiber is manufactured with one selected from a Viscose process and a Lyocell process. Advantages include that the tensile strength of the fiber is improved and it is possible to manufacture improved cellulose fibers which comprise a fraction of recycled material.

18 Claims, No Drawings

CELLULOSE FIBERS

This application is a national phase of International Application No. PCT/EP2017/081569 filed Dec. 5, 2017 and published in the English language, which claims priority to Swedish Application No. 1651600-7 filed Dec. 6, 2016, both of which are hereby incorporated by reference.

TECHNICAL FIELD

The present invention relates to a fiber manufactured for instance with the Lyocell process or the viscose process, said fiber comprising a mixture of a regenerate cellulose fiber and a dissolving pulp.

BACKGROUND

Cellulose is an important constituent in plants and comprises anhydrous glucose units. Cellulose is utilized for making synthetic fibers for instance by spinning a yarn or a thread. Recycled cellulose can be regenerated and used for spinning yarn, thread, fibers etc.

There are several known ways to dissolve cellulose for various applications including manufacture of regenerated cellulosic fiber. Often expensive chemicals are used in such processes. (Ohno H and Fukaya Y (2009) Task specific ionic liquids for cellulose technology Chemistry Letters V38)

WO2013124265 discloses a process for the regeneration of cellulose. It discloses treatment of cellulose in an alkaline step and with oxygen. Reduction of the viscosity with oxygen is mentioned. Recycling of cloth is mentioned and a pre-treatment may be desirable to lower the degree of polymerization. It is also mentioned that the cellulose can be used to make a new fiber such as Viscose.

WO 20101124944 discloses a process for the hydrolysis of cellulose comprising the sequential steps: a) mixing cellulose with a viscosity below 900 ml/g with an aqueous solution to obtain a liquid, wherein particles comprising cellulose in said liquid have a diameter of maximum 200 nm, wherein the temperature of the aqueous solution is below 35° C., and wherein the pH of the aqueous solution is above 12, b) subjecting the liquid to at least one of the steps: i) decreasing the pH of the liquid with at least 1 pH unit, ii) increasing the temperature by at least 20° C., and c) hydrolyzing the cellulose.

WO2012057684 discloses a process for derivatization of cellulose. The cellulose which should not have too high viscosity is subjected to high pH and low temperature where after the pH is increased and/or the temperature is increased. Then the cellulose is derivatized.

WO2013004909 discloses a method of removing hemicelluloses from pulp.

WO2014162062 discloses a method for manufacturing a shaped article of cellulose. It comprises use of a dissolved cellulose material. The cellulose is dissolved with a certain class of solvents (DBN-based ionic liquids).

CN102747622 discloses a process for removing the indigo color from jeans. The fabric is put water in a weight ratio of 1:20-30 and heating at 85-95° C., adding 2-3 g/l of sodium hydroxide, 4-5 g/l of peeling agent, 3-5 g/l of peregal and 4-5 g/l of sodium hydrosulfite and performing ultrasonic vibration and, draining the mixed solution, and washing the fabric using water 2-3 times.

WO2014/045062 discloses a process for extracting polyester with the aid of solvents.

U.S. Pat. No. 5,609,676 discloses a process comprising a ripening step to increase the reactivity before treatment with carbon disulfide to manufacture reusable viscose. The ripening step is immediately before the viscose manufacturing and has the purpose to adjust the polymerization degree of the cellulose. The ripening can be made with an alkali solution but also with cellulose degrading enzymes (cellulases). According to U.S. Pat. No. 5,609,676 it is also possible to degrade the celluloses with dilute $H_2SO_4$. There is also disclosed treatment with a reducing Sulphur compound exclusively before the ripening step.

WO 2015/077807 discloses a process for pretreating reclaimed cotton fibers to be used in the production of moulded bodies from regenerated cellulose, wherein the process comprises a metal removing stage and an oxidative bleach.

Viscose is a fiber of regenerated cellulose; it is structurally similar to cotton. To prepare Viscose, dissolving pulp is treated with aqueous sodium hydroxide (typically 16-19 wt %) to form alkali cellulose. The alkali cellulose is then treated with carbon disulfide to form sodium cellulose xanthate.

The higher the ratio of cellulose to combined sulfur, the lower the solubility of the cellulose xanthate. The xanthate is dissolved in aqueous sodium hydroxide (typically 2-5% w/w) and allowed to depolymerize to a desired extent, indicated by the solution's viscosity. The rate of depolymerization (ripening or maturing) depends on temperature and is affected by the presence of various inorganic and organic additives, such as metal oxides and hydroxides. Air also affects the ripening process since oxygen causes depolymerization.

Rayon fiber is produced from the ripened solutions by treatment with a mineral acid, such as sulfuric acid. In this step, the xanthate groups are hydrolyzed to regenerate cellulose and release dithiocarbonic acid that later decomposes to carbon disulfide and water. This gives regenerated cellulose. The thread made from the regenerated cellulose is washed to remove residual acid. The sulfur is then removed by the addition of sodium sulfide solution and impurities are oxidized by bleaching with sodium hypochlorite solution.

In the Lyocell process wood is chipped and digested chemically, to remove the lignin and to soften them enough to be mechanically milled to a wet pulp. This pulp may be bleached. Then it is dried into a continuous sheet and rolled onto spools. N-methylmorpholine N-oxide is most often the solvent in the Lyocell Process. The pulp is dissolved in N-methylmorpholine N-oxide, giving a solution called "dope." The filtered cellulose solution is then pumped through spinnerets, devices used with a variety of manmade fibers. The spinneret is pierced with small holes rather like a showerhead; when the solution is forced through it, continuous strands of filament come out. The fibers are drawn in air to align the cellulose molecules, giving the Lyocell fibers its characteristic high strength. The fibers are then immersed in another solution of amine oxide, diluted this time, which sets the fiber strands. Then they are washed with de-mineralized water. The Lyocell fiber next passes to a drying area, where the water is evaporated from it. The strands then pass to a finishing area, where a lubricant, which may be a soap or silicone or other agent depending on the future use of the fiber, is applied. This step is basically a detangler, prior to carding and spinning into yarn.

The dried, finished fibers are at this stage in a form called tow, a large untwisted bundle of continuous lengths of filament. The bundles of tow are taken to a crimper, a machine that compresses the fiber, giving it texture and bulk. The crimped fiber is carded by mechanical carders, which perform an action like combing, to separate and order the strands. The carded strands are cut and baled for shipment to a fabric mill. The entire manufacturing process, from unrolling the raw cellulose to baling the fiber, takes about two hours. After this, the Lyocell may be processed in many ways. It may be spun with another fiber, such as cotton or wool. The resulting yarn can be woven or knitted like any other fabric, and may be given a variety of finishes, from soft and suede-like to silky.

A process for the production of Lyocell fibers is described, for instance, in U.S. Pat. No. 4,246,221. Lyocell fibers are distinguished by a high tensile strength, a high wet-modulus and a high loop strength Still, there is a need for an improved fiber for instance manufactured with a solvent spinning process such as the Lyocell process or manufactured with the Viscose process. For instance, there is a need to improve the tensile strength of fibers. It is also desirable to provide a fiber which is at least partially recycled.

SUMMARY

It is an object of the present invention to obviate at least some of the disadvantages in the prior art and provide an improved fiber as well as a method of manufacturing it.

The inventors have discovered that if a fraction of specially treated recycled textile is mixed together with cellulose dissolving pulp, and then made into a fiber using the Viscose or the Lyocell process, then an unexpected strengthening of the resulting fiber occurs. This is seen as an increased tensile strength of the finished fiber.

In a first aspect there is provided a cellulose based fiber made of a i) cellulose dissolving pulp, and ii) a material made from recycled textile comprising cellulose, which is treated to swell the cellulose under reducing conditions together with at least one reducing additive present at least during a part of the swelling and treated in at least one of the following bleaching steps a) bleaching with oxygen at alkaline conditions with a pH in the range 9-13.5 and b) bleaching with ozone at acid conditions below pH 6, wherein the cellulose based fiber is manufactured with one selected from a Viscose process and a Lyocell process.

One advantage is that the tensile strength of the fiber is improved. Further the process makes it possible to manufacture cellulose fibers with excellent properties and which comprise a fraction of recycled material.

DETAILED DESCRIPTION

Before the invention is disclosed and described in detail, it is to be understood that this invention is not limited to particular compounds, configurations, method steps, substrates, and materials disclosed herein as such compounds, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

"Solution" is used herein to denote a homogeneous mixture comprising at least one substance dissolved in a solvent.

The term "decolourisation" should be understood to mean a loss of absorbance at one or more wavelengths of light of the contaminant. Typically, decolourisation involves loss of absorbance at one or more visible wavelengths of light. Furthermore, decolourisation may be partial or complete.

The term "cellulosic material" as used herein refers to all natural cellulosic forms (cotton, linen, jute, etc.) and all regenerated cellulosic forms such as rayon. In particular all textiles comprising cellulose are encompassed including textiles comprising treated and modified cellulose.

By "dissolving pulp" (which is sometimes also called dissolving cellulose or cellulose dissolving pulp), is meant a bleached wood pulp or cotton linters that has a high cellulose content (90 wt % or more). It has special properties including as a high level of brightness and uniform molecular-weight distribution. Dissolving pulp is so named because it is not made into paper, but dissolved either in a solvent or by derivatization into a homogeneous solution, which makes it completely chemically accessible and removes any remaining fibrous structure.

In a first aspect there is provided a cellulose based fiber made of a i) cellulose dissolving pulp, and ii) a material made from recycled textile comprising cellulose, which is treated to swell the cellulose under reducing conditions together with at least one reducing additive present at least during a part of the swelling and treated in at least one of the following bleaching steps a) bleaching with oxygen at alkaline conditions with a pH in the range 9-13.5 and b) bleaching with ozone at acid conditions below pH 6, wherein the cellulose based fiber is manufactured with one selected from a Viscose process and a Lyocell process.

In one embodiment the cellulose dissolving pulp is from a virgin source. In one embodiment the cellulose dissolving pulp is of a type normally used in a Viscose process. In another embodiment the cellulose dissolving pulp is of a type normally used in a Lyocell process.

In one embodiment the material made from recycled textile constitutes at least 10 wt % of the cellulose based fiber. In an alternative embodiment the material made from recycled textile constitutes at least 7 wt % of the cellulose based fiber. In an alternative embodiment the material made from recycled textile constitutes at least 15 wt % of the cellulose based fiber. In an alternative embodiment the material made from recycled textile constitutes at least 20 wt % of the cellulose based fiber. The material made from recycled textile is the special type of recycled cellulose textile treated as described. The amount of cellulose based fiber is calculated by weight of cellulose based fiber in relation to the total weight of the cellulose based fiber.

The material made from recycled textile is manufactured according to the following scheme:

a. providing at least one textile material comprising cellulose,
b. treating the material to swell the cellulose, under reducing conditions, wherein at least one reducing agent is present at least during a part of the swelling,
c. performing at least one of the following two bleaching steps in any order i.bleaching the material with oxygen at alkaline conditions with a pH in the range 9-13.5, and ii.bleaching the material with ozone at acid conditions below pH 6.

The steps a), b), and c) should be carried out in sequential order, with the proviso that the at least one bleaching step c) i) and c) ii) can be carried out in any order.

In one embodiment the at least one textile is at least one selected from the group consisting of cotton, Lyocell, rayon, and Viscose. In one embodiment the at least one textile is cotton. It has been shown that textiles comprising cellulose such as cotton can suitably be recycled using the present method. Mixtures of different types of textiles are also encompassed as long as at least a part of the textiles comprise cellulose.

In one embodiment the textile is mechanically disintegrated before step b) so that the textile is at least partially disintegrated in order to improve the subsequent steps. In one embodiment the textile is mechanically disintegrated in a shredder before step b). Other methods of disintegrating the textiles are also encompassed. The shredding and disintegration creates a larger surface of the material so that the subsequent steps are facilitated.

In one embodiment the pH during step b) is in the range of 9-13.5. In another embodiment the pH during step b) is in the range of 11-13.3. The swelling is thus in these embodiments carried out under alkaline pH. In one embodiment NaOH is present during step b) in a concentration from 0.01 to 0.5 mol/l. NaOH has the advantage of being a cost efficient way of raising the pH.

In one embodiment the temperature during step b) is in the range 50-100° C.

In one embodiment the at least one reducing additive comprises sodium dithionite, $Na_2S_2O_4$. In other embodiments other reducing additives are used. In one embodiment sodium dithionite, $Na_2S_2O_4$ is present during step b) in a concentration from 0.01 to 0.25 mol/l.

During the bleaching step c) the chain length of cellulose is reduced together with other effects on the material. The bleaching is in one embodiment step c) i) only. In another embodiment the bleaching is step c) ii) only. In yet another embodiment the bleaching comprises both step c) i) and step c) ii) carried out in any order. I.e. in one embodiment the bleaching comprises step c) i) followed by step c) ii) and in an alternative embodiment the bleaching comprises step c) ii) followed by step c) i).

In one embodiment the bleaching in step c)-i) is carried out at a temperature in the interval 60-120° C.

In one embodiment, wherein the bleaching in step c)-i) is carried out during 20 minutes-24 hours. In one embodiment the upper limit is about two hours, however in an alternative embodiment extended bleaching is carried out, this is referred to as aging. In one embodiment the bleaching in step c)-i) is carried out during 30 min-120 min.

In one embodiment a wash is carried out before step c) ii). Since step c) ii) is carried out at low pH and when the preceding step is carried out at high pH it is an advantage to wash before the pH is lowered in step c) ii). In one embodiment the material is dewatered to a water content of less than 66 wt % before step c) ii). This step also serves to minimize the carry-over of liquid with high pH to the step with low pH. In one embodiment the pH during step c) ii) is in the interval pH 1.5-5.

The cellulose is recovered after step c). The recovered cellulose is mixed in the dissolving pulp and used for making a cellulose fiber.

In a second aspect there is provided a method for manufacturing a cellulose based fiber, comprising the step of mixing:

i) cellulose dissolving pulp, and ii) a material made from recycled textile comprising cellulose, which is treated to swell the cellulose under reducing conditions together with at least one reducing additive present at least during a part of the swelling and treated in at least one of the following bleaching steps a) bleaching with oxygen at alkaline conditions with a pH in the range 9-13.5 and b) bleaching with ozone at acid conditions below pH 6, wherein the cellulose based fiber is manufactured with one selected from a Viscose process and a Lyocell process.

In one embodiment the cellulose based fiber is manufactured with a Lyocell process. A skilled person is aware of both the Viscose process and the Lyocell process and can carry out those processes.

Other features and uses of the invention and their associated advantages will be evident to a person skilled in the art upon reading this description and the appended examples.

It is to be understood that this invention is not limited to the particular embodiments shown here. The following examples are provided for illustrative purposes and are not intended to limit the scope of the invention since the scope of the present invention is limited only by the appended claims and equivalents thereof.

EXAMPLES

The recycled material from textiles is called re:newcell pulp and it was manufactured using the following scheme:

Cotton linters were cut into small pieces.

The material was mixed together with NaOH until a pH of 12 was reached and with an addition of sodium dithionite, $Na_2S_2O_4$ in a swelling step. The reductive treatment during swelling was carried out at 85° C. for 30 minutes. Thereafter the material was washed and dried at 60° C.

Subsequently ozone treatment was carried out at low pH by treating in 1% $H_2SO_4$ for 15 min followed by ozone treatment for 5 min.

Dissolving pulp was obtained from Södra Cell in a grade called Södra orange. It has been formulated to meet the needs of the Lyocell process in which pulp is treated directly with a solvent as opposed to the more common Viscose process which requires a chemical reaction to dissolve cellulose. The process demands a high level of purity. Its alkali resistance is over 96% while viscosity is low, which is important for the final textile fiber's properties and good runnability at the customer's end.

Fibers were made from Södra orange mixed with various degrees of re:newcell pulp as well as from 100% re:newcell. The fibers were made using the Lyocell process: Laboratory dissolution tests were carried out using different blend ratios of the delivered cellulose samples as well as different cellulose concentrations in the cellulose direct dissolution agent N-methylmorpholine-N-oxide monohydrate (NMMO). For blending, the necessary amounts of both cellulose samples were suspended and disintegrated commonly in water using an Ultra-Turrax tool. Then, the excess of water was pressed out and the blending pulp samples were suspended in 50 wt-% aqueous NMMO. The solution preparation took place using a laboratory kneader through removal of the water by means of heating, shearing and pressure reducing during the solution process (80-95° C. mass temperature, 660-40 mbar pressure, 5-20 rpm).

Propyl gallate (0.5 wt-%, with regard to cellulose) and sodium hydroxide solution were used for stabilisation of the cellulose solutions. After the dissolution of the cellulose an after-dissolution time followed (60 minutes, 15 rpm, 90° C. mass temperature and 250 mbar).

In the table below data from different experiments are summarized:

| Sample | VR16004 | V2928 | V2512.2 |
|---|---|---|---|
| Blend ratio Södra orange/ re:newcell By weight | 85/15 | 80/20 | 0/100 |
| Fineness dtex | 1.81 | 1.74 | 1.46 |
| Tensile strength, conditioned cN/tex | 39.2 | 42.7 | 52.7 |
| Elongation, conditioned % | 15.5 | 13.4 | 12.3 |
| Loop tenacity cN/tex | 22.1 | 18.7 | 13.7 |

It can be seen that the tensile strength (cN/tex) is improved by mixing in more re:newcell pulp.

The invention claimed is:

1. A method for manufacturing a cellulose based fiber, the method comprising:

1. providing a material made from recycled textile comprising cellulose, which material is a) treated to swell the cellulose under reducing conditions in which at least one reducing additive is present at least during a part of the swelling and b) treated in at least one of the following bleaching steps: i) bleaching with oxygen at alkaline conditions with a pH in the range 9-13.5 and ii) bleaching with ozone at acid conditions below pH 6, wherein the steps a) and b) are carried out in sequential order and wherein the bleaching steps i) and ii) may be carried out in any order if both i) and ii) are performed; and 2. mixing the material made from recycled textile comprising cellulose of step 1 with cellulose dissolving pulp; wherein the method of manufacturing the cellulose based fiber is one selected from a Viscose process and a Lyocell process.

2. The method according to claim 1, wherein the cellulose dissolving pulp is from a virgin source.

3. The method according to claim 1, wherein the cellulose based fiber is manufactured with a Viscose process.

4. The method according to claim 1, wherein the cellulose based fiber is manufactured with a Lyocell process.

5. The method according to claim 1, wherein the material made from recycled textile constitutes at least 10 wt % of the cellulose based fiber.

6. The method according to claim 1, wherein the recycled textile is at least one selected from the group consisting of cotton, Lyocell, rayon, and Viscose.

7. The method according to claim 1, wherein the recycled textile is cotton.

8. The method according to claim 1, wherein the recycled textile is mechanically disintegrated to at least partially disintegrate the cellulose before the swelling of the cellulose.

9. The method according to claim 1, wherein the pH during the swelling is in the range of 9-13.5.

10. The method according to claim 1, wherein NaOH is present during the swelling in a concentration from 0.01 to 0.5 mol/L.

11. The method according to claim 1, wherein the temperature during the swelling is in the range 50-100° C.

12. The method according to claim 1, wherein the at least one reducing additive comprises sodium dithionite, $Na_2S_2O_4$, in a concentration from 0.01 to 0.25 mol/L.

13. The method according to claim 1, wherein the bleaching with oxygen at alkaline conditions is carried out at a temperature in the interval 60-120° C.

14. The method according to claim 1, wherein the bleaching with oxygen at alkaline conditions is carried out during 20 minutes-24 hours.

15. The method according to claim 1, wherein the bleaching with oxygen at alkaline conditions is carried out during 30 min-120 min.

16. The method according to claim 1, wherein a wash is carried out before the bleaching with ozone at acid conditions.

17. The method according to claim 1, wherein the material is dewatered to a water content of less than 66 wt % before the bleaching with ozone at acid conditions.

18. The method according to claim 1, wherein the bleaching with ozone at acid conditions is carried out at a pH in the interval 1.5-5.

* * * * *